US005798020A

United States Patent [19]

Coughlin et al.

[11] Patent Number: 5,798,020

[45] Date of Patent: Aug. 25, 1998

[54] MEDICINE VIAL LABELER

[75] Inventors: Michael E. Coughlin, Overland Park, Kans.; Ronald A. Leonard, Peculiar, Mo.; Lawrence E. Guerra, Roeland Park; Keith W. Kudera, Merriam, both of Kans.

[73] Assignee: Scriptpro, LLC, Mission, Kans.

[21] Appl. No.: 880,893

[22] Filed: Jun. 23, 1997

[51] Int. Cl.[6] ..... B65C 9/00

[52] U.S. Cl. ..... 156/542; 156/446; 156/361; 156/184; 156/DIG. 26

[58] Field of Search ..... 156/86, 446, 447, 156/350, 361, 358, 542, DIG. 26, DIG. 13, 184

[56] References Cited

U.S. PATENT DOCUMENTS 4,468,277 8/1984 Kontz ..... 156/DIG. 26 X 4,714,515 12/1987 Hoffmann ..... 156/DIG. 26 X 4,851,072 7/1989 Kontz ..... 156/DIG. 13 X 5,337,919 8/1994 Spauding et al. .

*Primary Examiner*—James Engel

*Attorney, Agent, or Firm*—Hovey, Williams, Timmons & Collins

[57] ABSTRACT

A medicine vial labeler includes a dispenser for printing and dispensing pressure sensitive labels and a label applicator assembly including a rotary drum and a pair of positioning arms. The positioning arms are shiftable from a release position to a holding position for positioning a vial in rotary contact with the drum in order to receive a label in the nip therebetween applying the label to the vial upon rotation of the drum. The positioning arms include a plurality of rollers of different diameters configured and spaced for holding and positioning vials of different diameters in rotary contact with the drum.

11 Claims, 4 Drawing Sheets

MEDICINE VIAL LABELER

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention generally relates to the field of machines for automatically dispensing medical prescriptions. In particular, the invention is concerned with a medicine vial labeler having a dispenser for printing and dispensing pressure sensitive labels, and a label applicator assembly including a rotary drum and a pair of positioning arms configured for positioning vials of different diameters in rotary contact with the drum for application of a label received in the nip therebetween to the vial.

2. Description of the Prior Art

In the field of automatic prescription dispensing machines, a vial is automatically filled with prescribed medicament and presented without a label thereon to a pharmacist. A printer dispenses a pressure sensitive label with the associated prescription thereon to the pharmacist for manual application of the label to the vial. When a plurality of prescriptions are to be processed, filled vials are presented in sequence and the corresponding labels are dispensed in sequence.

Difficulties can arise, for example, if the printer malfunctions. In this situation, the sequence of reprinted labels can be confused leading to the risk of applying the wrong label to a vial. Similarly, if the vial filling mechanism malfunctions, the sequence of vials for labeling can also become confused, again leading to the risk of a mislabeled vial.

The use of automatic labelers has not been a reliable solution to this problem because medicine vials in common usage present different diameters. Prior art labelers have not been able to accommodate automatic labeling of medicine vials of different diameters.

SUMMARY OF THE INVENTION

The present invention solves the prior art problems discussed above and presents a distinct advance in the state of the art. More particularly, the medicine vial labeler hereof is able to accommodate medicine vials of different diameters and to label these vials one at a time in order to minimize the risk of mislabeling.

The preferred labeler apparatus includes a label dispenser, a holding assembly, and a conveyor. The label dispenser prints and dispenses one pressure sensitive label at a time for application to an associated filled vial. The dispenser includes a selectively actuatable rotary drum and the holding assembly includes a pair of shiftable positioning arms having rollers coupled therewith for placing a vial to be labeled in rotary contact with the drum.

The conveyor positions a vial to be labeled between the arms and the drum. The arms then pivot toward one another and toward the drum thereby positioning the vial in rotary contact with the drum. The label is received in the nip between the vial and drum whereupon the drum rotates also causing the vial to rotate in order to apply the label thereto. The rollers are configured and positioned on the arms for holding vials of different diameters in rotary contact with the drum for labeling. Other preferred aspects of the present invention are disclosed herein.

DETAILED DESCRIPTION OF THE PREFERRED EMBODIMENT

Figure 1:
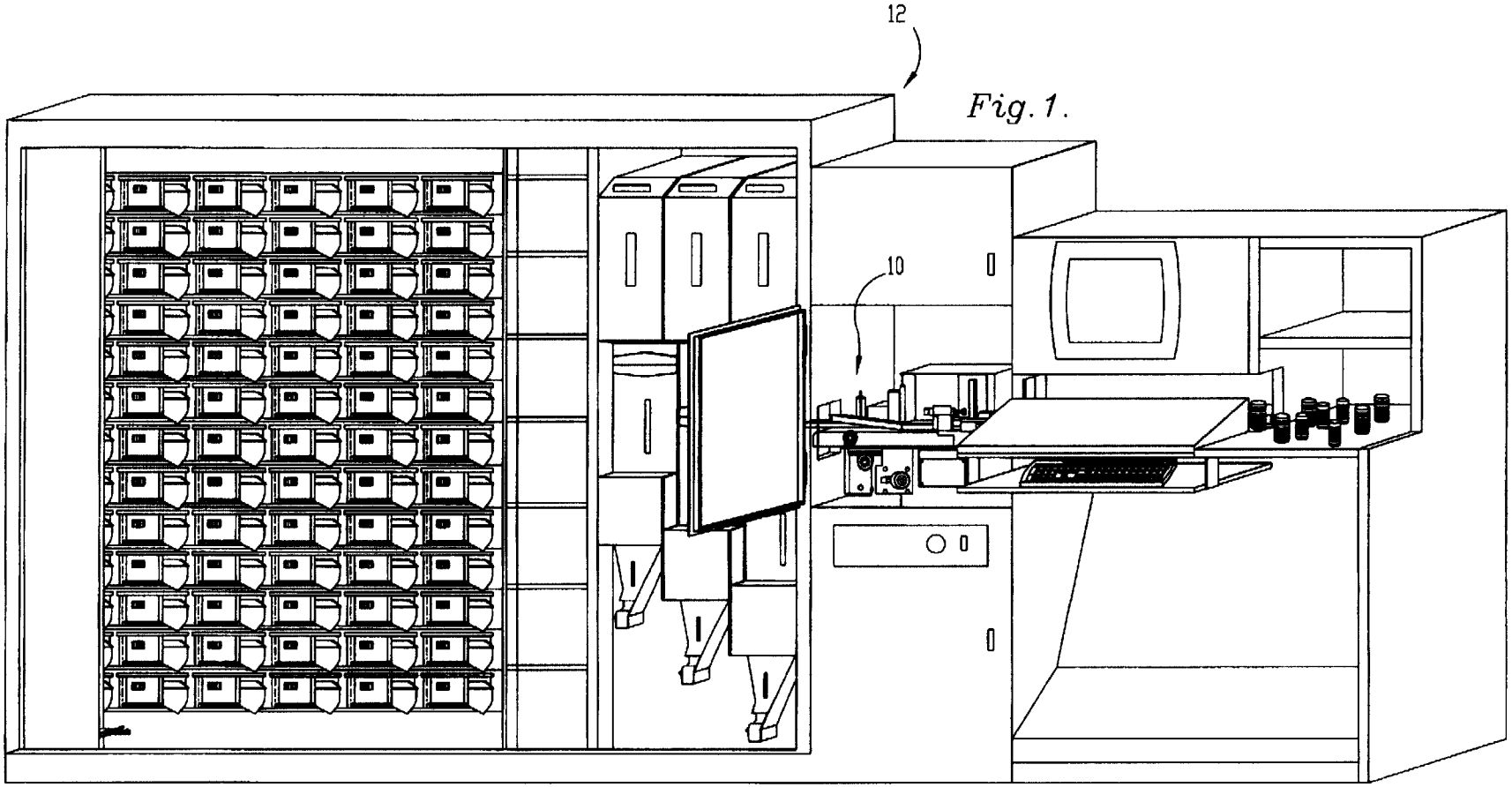
FIG. 1 is a pictorial view of the preferred labeler apparatus of the present invention shown in use with an automatic prescription dispensing machine.
Figure 2:
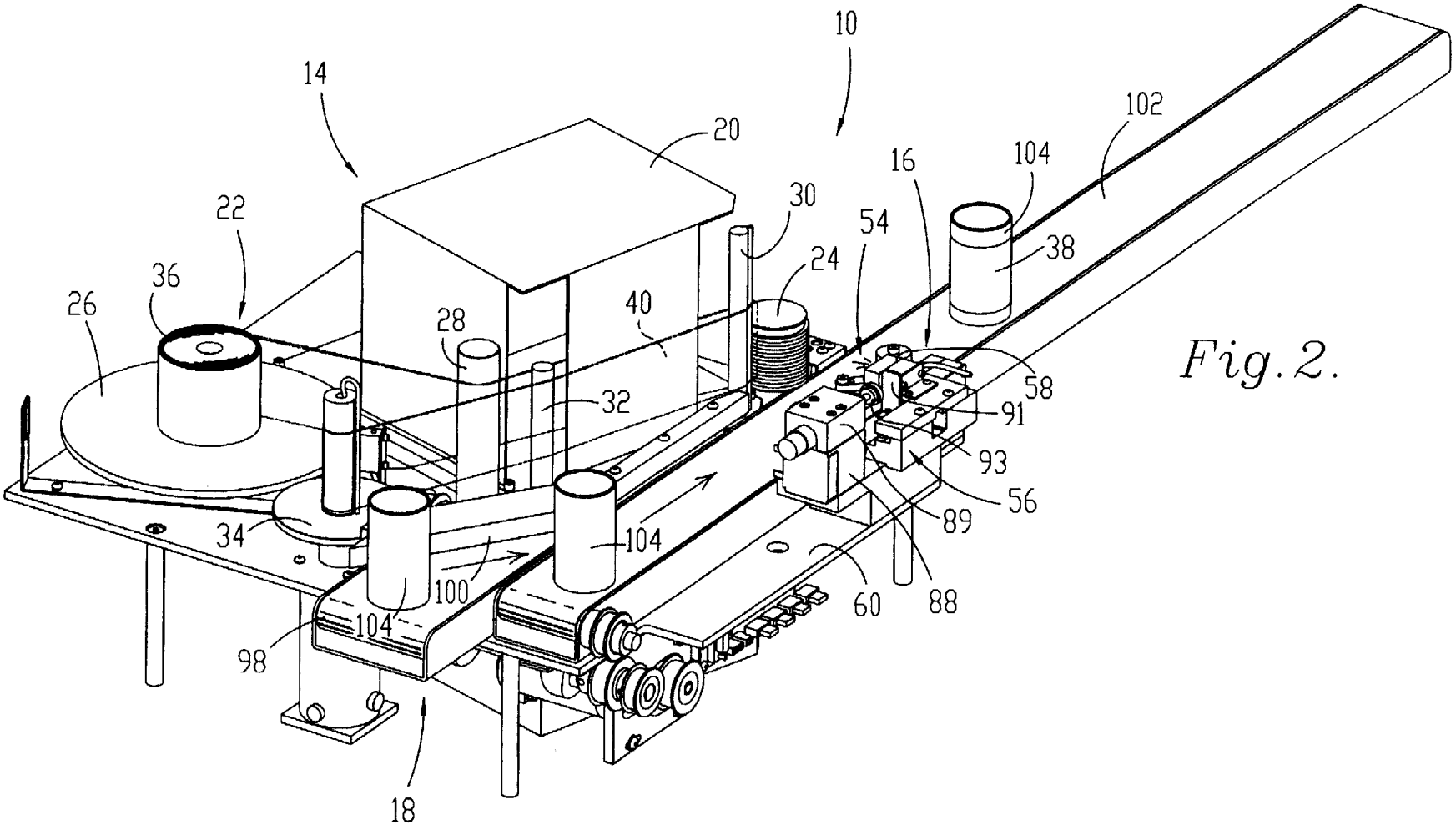
FIG. 2 is a pictorial view of the preferred labeler apparatus of FIG. 1.

FIG. 1 illustrates preferred label apparatus 10 in accordance with the present invention shown in use with an automatic prescription dispensing machine 12 such as that illustrated in U.S. Pat. No. 5,337,919, hereby incorporated by reference as part of the disclosure hereof. Apparatus 10 broadly includes label dispenser 14, holding assembly 16 and conveyor 18.

Referring to FIGS. 2–6, label dispenser 14 includes label printer 20, dispensing assembly 22 and rotary drum 24. Printer 20 is conventional in nature such as a thermal transfer printer (Sato Model M8400S/8) and receives commands from the control system (not shown) of machine 12 including prescription data to be printed on a label for a particular vial.

Dispensing assembly includes feed reel 26, guide post 28, anvil 30, guide post 32 and take-up reel 34. Feed reel 26 receives a roll 36 of pressure sensitive labels 38 spaced along a carrier sheet 40. Feed reel 26 dispenses carrier sheet 40 with labels 38 thereon from feed reel 26, around guide post 32, through printer 20 for printing labels 38, to anvil 30.

The sharp turn and edge of anvil 30 causes labels 38, such as label **38*a*, to peel away from carrier sheet 40. A label being dispensed at anvil 30 presents leading edge 50 and trailing edge 52. Each label also presents the printed label face 51 and an opposed adhesive face 53 having pressure sensitive adhesive thereon. Rotary drum 24 is positioned adjacent anvil 30 for receiving leading edge 50 of label 38*a* with label face 51 adjacent drum 24. The carrier sheet then continues around guide post 32 to take-up reel 34**.

Holding assembly 16 includes positioning arm assembly 54, actuator mechanism 56 and photoelectric eye 58 all mounted to support base 60. Positioning arm assembly 54 includes angled first positioning arm 62 presenting inboard end 64 and outboard end 66 having rollers 68 and 70 coupled therewith, and angled second positioning arm 72 presenting inboard end 74 and outboard end 76 and having roller 78 coupled therewith. In the preferred embodiment, roller 68 presents a diameter of about 1.0 inches and is positioned adjacent first arm outboard end 66, and roller 70 presents a diameter of about 0.75 inches and is coupled adjacent roller 68. Roller 78 is coupled with second arm 72 adjacent outboard end 76 and presents a diameter of about 1.0 inches. With this configuration, assembly 54 can hold vials in rotary contact with drum 24 ranging in diameter from 1.0 to 2.0 inches.

Pivot coupler 80 pivotally couples positioning arms 62 and 72 through slots 82*a* and 82*b* adjacent the respective inboard ends 64, 74 thereof. Pivot pin 84 pivotally couples first arm 62 adjacent the angle bend with support base 60 and similarly, pivot pin 86 pivotally couples second arm adjacent the angle bend with support base 60.

Figure 4:
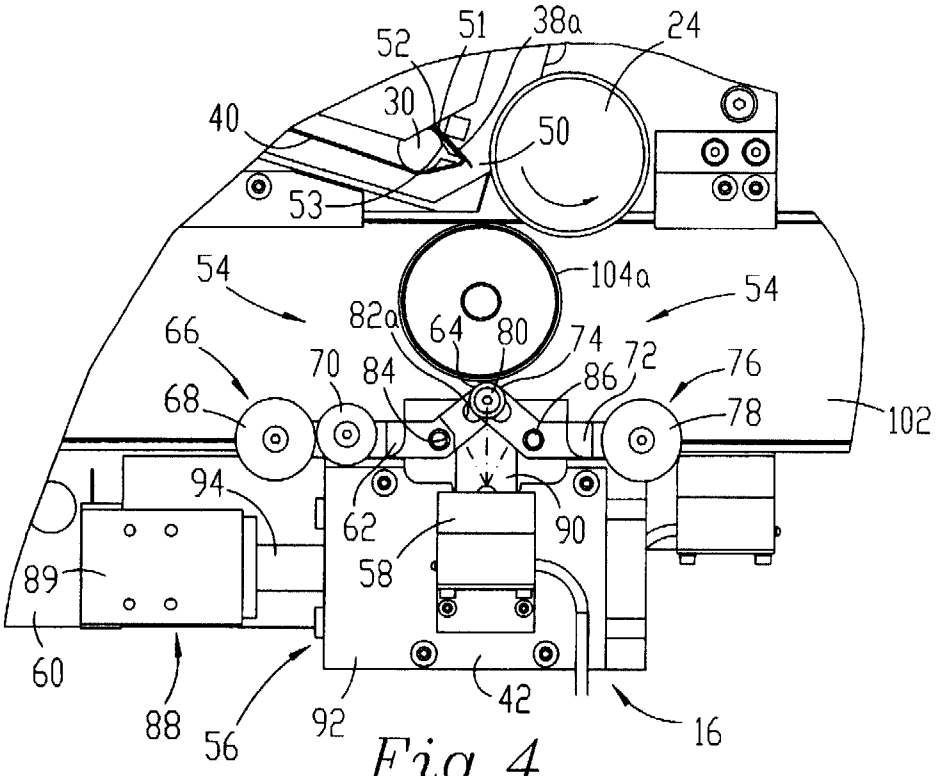
FIG. 4 is a partial plan view of the apparatus of FIG. 3 showing the positioning arms in the release position.
Figure 3:
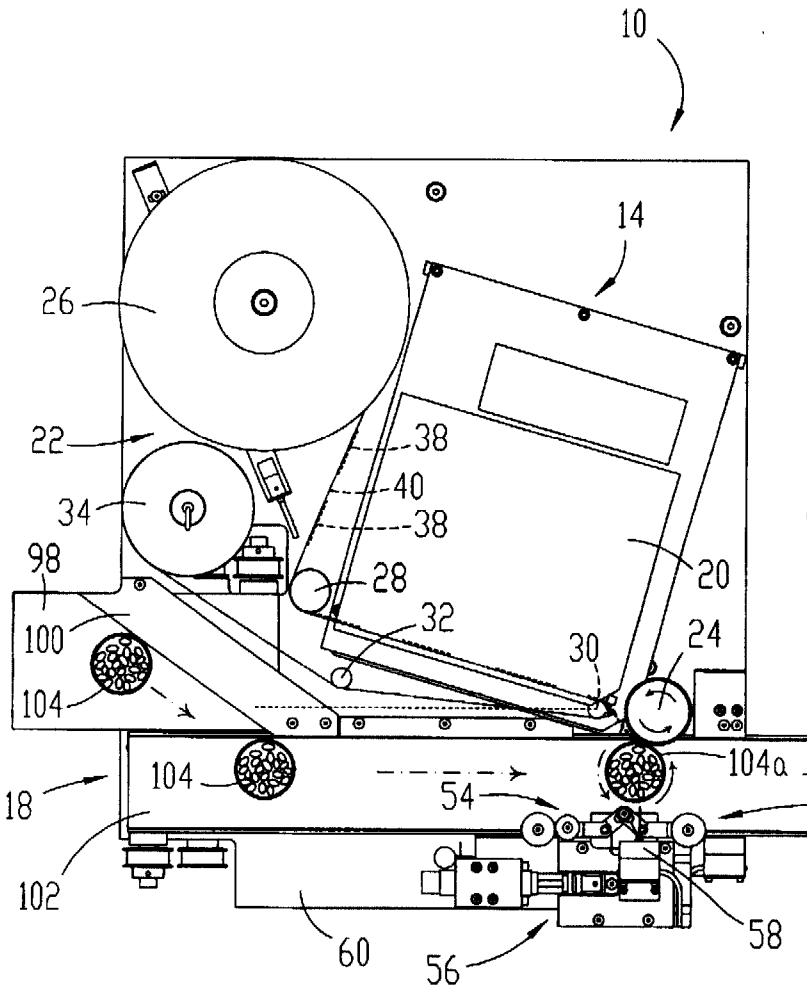
FIG. 3 is a plan view of the apparatus of FIG. 2.

Actuator mechanism 56 includes electrically actuated solenoid 88 with linear decelerator 89 attached thereto, operator 90 connected to pivot coupler 80, and right angle, actuator box 92 interconnecting solenoid 88 and operator 90. FIG. 4 illustrates first and second positioning arms 62, 72 in the release position. Electrical actuation of solenoid 88 causes leftward movement of solenoid shaft 94. Through the operation of actuator box 92, this results in operator 90 moving downwardly, that is, transverse to the axis between pivot pins 84, 86. This causes arms 62, 72 to rotate about pins 84, 86 toward one another and toward drum 24 to the holding position illustrated in FIGS. 5 and 6. When shaft 94 moves, bracket 91 attached thereto engages plunger 93 of decelerator 89 to slow the movement of shaft 94, ensuring gentle positioning of arm 62, 72 to the holding position and thereby gentle positioning of a vial against drum 24.

Conveyor 18 includes first conveyor belt 98, guide rail 100 and second conveyor belt 102. First conveyor belt 98 is relatively short and extends into the operating area of prescription machine 12 for receiving a filled vial therefrom placed by a manipulator arm, in the preferred embodiment.

In operation, a vial moving along first conveyor belt 98 encounters guide rail 100 which shifts the vial to second conveyor belt 102, which extends between drum 24 and holding assembly 16 and further into the vial inspection area of machine 12. Photoelectric eye 58 is positioned so that the field of view thereof encompasses the area of conveyor 18 between arms 62, 72 and rotary drum 24. Entry of a vial such as vial 104 into this field of view prompts a sequence of events including the stopping of belts 98 and 102. Next, solenoid 88 is actuated to shift arms 62, 72 to the holding position in order to place vial 104 in rotary contact with drum 24.

Label dispenser 14 is then activated to rotate drum 24 and take-up reel 34. The rotation of drum 24 also causes vial 104 to rotate along with rollers 68, 70 and 78 as indicated by the arrows in FIGS. 5 and 6. The activation of take-up reel 34 causes the leading edge 50 of the next label 38*a* to enter the nip between drum 24 and vial 104. Continued operation of take-up reel 34 continues the dispensing of label 38*a* until adhered to vial 104.

The operation of label dispenser 14 is then stopped and solenoid 88 de-energized which returns arms 62, 72 to the release position. Next, belts 98, 102 are started to convey the labeled vial to the inspection area. This also results in presentation of the next vial to be labeled.

Figures 5, 6:
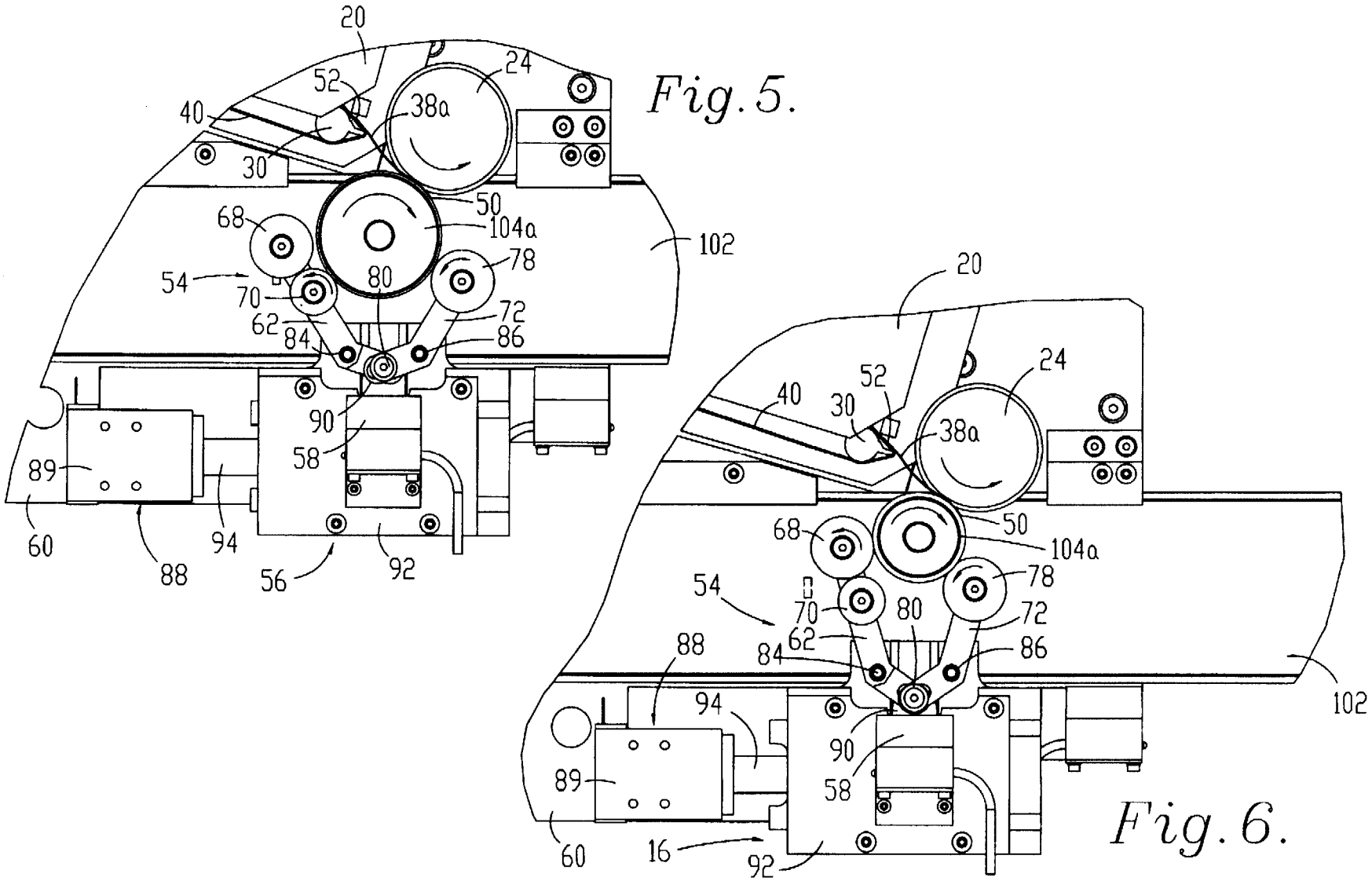
FIG. 5 is a view similar to FIG. 4 but showing the arms in the holding position and holding a vial in rotary contact with the rotary drum.
FIG. 6 is a view similar to FIG. 5 but showing a vial of a smaller diameter.

FIG. 5 illustrates the labeling operation for a vial of about 2.0 inches in diameter. With this size of vial, rollers 70 and 78 engage the periphery of the vial and hold it in rotary contact with drum 24. FIG. 6 illustrates the labeling operation for a vial of smaller diameter such as 1.2 inches. With this vial, roller 68 and 78 engage the vial and hold it in rotary contact with drum 24. Thus, holding assembly 16 is able to place vials having a plurality of different diameters in rotary contact with drum 24 for application of a label.

Those skilled in the art will appreciate that the present invention encompasses many variations in the preferred embodiment described herein. For example, rollers 68, 70 and 78 can be configured with other dimensions in order to accommodate other ranges of vial sizes. Moreover, the present invention finds utility for labeling cylindrically shaped objects other than medicine vials.

Having thus described the preferred embodiments of the present invention, the following is claimed as new and desired to be secured by Letters Patent:

1. A labeler apparatus for applying a label to a cylindrically shaped object, the label presenting a label face and an opposed adhesive face with adhesive thereon, said apparatus comprising:

label dispensing means for dispensing a label from a source thereof and including a selectively actuatable rotatable drum positioned for receiving dispensed labels, the label presenting a leading edge and a trailing edge as dispensed; and holding means for holding an object to be labeled in rotary contact with said drum for receiving the leading edge of the label in the nip between the object and said drum with the adhesive face in contact with the object in order to apply the label to the object upon rotation of said drum and rotation the object in response, said holding means including first and second holding arms having respective inboard and outboard ends and being pivotally coupled adjacent said respective inboard ends, first pivot means pivotally coupling said first arm between said ends thereof with a support base, and second pivot means, spaced from said first pivot means, pivotally coupling said second arm between said ends thereof with said support base, a plurality of rollers coupled with said arms, and actuator means coupled with said arms adjacent said inboard ends thereof for selectively pivoting said arms about said respective first and second pivot means between a release position in which said arms are pivoted away from one another, and a holding position in which said arms are pivoted toward one another and toward said drum, said rollers being configured and positioned for holding objects of different diameters in rotary contact with said drum when in said holding position.

2. The apparatus as set forth in claim 1, said label dispensing means including means for dispensing a plurality of labels in sequence.

3. The apparatus as set forth in claim 2, said labels being pressure sensitive labels supplied on a carrier sheet, said dispensing means including means for dispensing the labels in sequence from the carrier sheet.

4. The apparatus as set forth in claim 2 further including a printer for printing each label before dispensing.

5. The apparatus as set forth in claim 1 further including a conveyor between said holding means and drum configured for presenting an object therebetween for labeling and for carrying away an object after labeling.

6. The apparatus as set forth in claim 1, said arms presenting a substantially linear configuration when in said release position.

7. The apparatus as set forth in claim 1, said first and second pivot means presenting an axis therebetween, said actuator means including means for shifting said inboard ends transverse to said axis.

8. The apparatus as set forth in claim 1, said first arm presenting a pair of said rollers spaced from one another and presenting different diameters, said second arm presenting one of said rollers.

9. The apparatus as set forth in claim 1, said actuator means including a solenoid.

10. The apparatus as set forth in claim 1, the object being a medicine vial.

11. A labeler apparatus for applying a label to a cylindrically shaped medicine vial, the label presenting a label face and an opposed adhesive face with adhesive thereon, said apparatus comprising:

label dispensing means for receiving a label from a source thereof, printing the label with the prescription associated with the contents of a vial to be labeled, and dispensing the label for application to the vial, the label presenting a leading edge and a trailing edge as dispensed; and label applicator means, including a selectively actuatable rotatable drum and holding means spaced therefrom for holding a vial in rotary contact with said drum for labeling and subsequent release, for positioning the label in the nip between the vial and said drum and then actuating said drum to rotate and thereby to rotate the vial until the label has been applied to the vial, said holding means including first and second holding arms having respective inboard and outboard ends and being pivotally coupled adjacent said respective inboard ends, first pivot means pivotally coupling said first arm between said ends thereof with a support base, and second pivot means, spaced from said first pivot means, pivotally coupling said second arm between said ends thereof with said support base, first and second, spaced rollers presenting different diameters coupled with said first arm outboard of said first pivot means and a third roller coupled with said second arm outboard of said second pivot means, and actuator means coupled with said arms adjacent said inboard ends thereof for selectively shifting said inboard ends in a direction transverse to the axis between said first and second pivot means for pivoting said arms about said respective first and second pivot means between a release position in which said arms are pivoted away from one another, and a holding position in which said arms are pivoted toward one another and toward said drum, said rollers being configured and positioned for holding vials of different diameters in rotary contact with said drum for labeling when in said holding position; and conveyor means for conveying a vial to be labeled into a labeling position between said arms and said drum and for conveying the vial after labeling from said labeling position.

* * * * *